US005339898A

United States Patent [19]

Yu et al.

[11] Patent Number: 5,339,898

[45] Date of Patent: Aug. 23, 1994

[54] ELECTROMAGNETIC RESERVOIR HEATING WITH VERTICAL WELL SUPPLY AND HORIZONTAL WELL RETURN ELECTRODES

[75] Inventors: C. Lawrence Yu, Calgary; Bruce C. W. McGee, Edmonton; Frederick S. Chute, Edmonton; Fred E. Vermeulen, Edmonton, all of Canada

[73] Assignee: Texaco Canada Petroleum, Inc., Calgary, Canada

[21] Appl. No.: 90,973

[22] Filed: Jul. 13, 1993

[51] Int. Cl.[5] ..... E21B 43/24

[52] U.S. Cl. ..... 166/248; 166/65.1

[58] Field of Search ..... 166/272, 302, 65.1, 166/248

[56] References Cited

U.S. PATENT DOCUMENTS

| | | | |
|---|---|---|---|
| 3,874,450 | 4/1975 | Kern | 166/65.1 X |
| 4,412,585 | 11/1983 | Boyck | 166/302 X |
| 4,489,782 | 12/1984 | Perkins | 166/248 |
| 4,545,435 | 10/1985 | Bridges et al. | 166/65.1 X |
| 4,567,945 | 2/1986 | Segalman | 166/302 X |
| 4,640,353 | 2/1987 | Schuh | 166/248 |
| 4,729,429 | 3/1988 | Wittrisch | 166/65.1 |
| 5,054,551 | 10/1991 | Dyeksen | 166/272 |
| 5,236,039 | 8/1993 | Edelstein et al. | 166/65.1 X |

*Primary Examiner*—William P. Neuder

*Attorney, Agent, or Firm*—Millen, White, Zelano, & Branigan

[57] ABSTRACT

The invention involves combining a plurality of vertical wells, each having a power conditioning unit located on the surface and an electrode in electrical contact with the reservoir, with a horizontal well extending through the reservoir in spaced relation to the vertical wells. The liner and tubing of the horizontal well function as the common return means for the circuit. Low frequency current is supplied to flow between the vertical and horizontal wells at adequate levels so as to cause heating in the near-wellbore regions of all the wells. Oil is produced, at the same time as electrical heating, at enhanced rates as a result.

4 Claims, 6 Drawing Sheets

ELECTROMAGNETIC RESERVOIR HEATING WITH VERTICAL WELL SUPPLY AND HORIZONTAL WELL RETURN ELECTRODES

FIELD OF THE INVENTION

This invention relates to an assembly and method for electromagnetically heating oil-bearing reservoirs for improved production. More particularly, separate electrical supply electrodes are provided in vertical wells and a common ground return electrode is provided in a horizontal well.

BACKGROUND OF THE INVENTION

Electrically heating oil reservoirs is known and is usually practised to modify the mobility of the oil near the well-bore and to improve fluid transmissibility through the near-wellbore region. The reduced pressure in the near-wellbore region causes the oil in the region to lose light ends and develop increased viscosity. This region is referred to as the "visco-skin" and can significantly reduce production. By electrically heating the oil near the wellbore, the viscosity may be reduced and the visco-skin effect may be removed. Waxy hydrocarbons may also be sufficiently mobilized to aid in increased production.

In electrical heating of wells, it is conventional to:

- drill a vertical well into the oil reservoir and case it to the interface of the overburden and oil reservoir;
- install an electrode assembly in the well to extend into the reservoir from the foot of the casing, the assembly comprising an upper non-conductive tube (termed an "isolator"), a conductive tube (the electrode), and a bottom isolator, the electrode being in contact with or electrically coupled to the reservoir;
- install a string of tubing in the casing, electrically isolated from the casing by annular dielectric centralizers, the tubing being electrically connected with the electrode by a conductive bow spring device;
- the tubing string being connected at ground surface to the positive lead of a power conditioning unit, so that AC current is supplied down the tubing and through the bow spring device and electrode into the reservoir;
- the casing being connected to the negative lead of the power conditioning unit, whereby the current flows from the electrode, up through the near-bore region of the reservoir to the casing and up the casing to ground.

Thus the electrical circuit used to do electrical heating consists of the power conditioning unit, the power delivery system (tubing and bow spring device), the electrode, the reservoir, and the return system (casing).

The withdrawal of fluids from the reservoir by way of the well usually occurs at the same time as electrical heating.

Generally, at practical current levels, the current density distribution may be sufficient to only heat the reservoir within about 5 to 10 meters radially from the electrode.

With most wells, the tubing string and casing are usually short and conductive enough that the largest part of the resistive load is in the reservoir. The reservoir resistance is typically 5 to 10 times larger than the combined resistances of the power delivery and ground return systems. This means that the majority of the electrical current is dissipated as heat in the reservoir and good power conversion efficiencies are achieved.

Despite the relatively high conversion efficiency of the prior art system, several disadvantages and limitations are related to the high amperages used.

First, delivery of the high current to the electrode is a significant consideration. If one uses cable instead of the tubing as part of the power delivery system, the cable is significantly de-rated due to its submerged condition and is limited to a current of less than 100 amperes before the cable may be damaged. Current levels of less than 100 amperes severely restrain the commercial application of the electrical heating process. A preferred approach is to use the tubing string itself which, even though it is a poorer conductor, is significantly cooled by the produced liquids from the reservoir. Use of the tubing string in an environment with cooling provided from the produced fluids, increases the current constraint of the power delivery system to more than 1000 amperes. The maximum current is therefore dependent upon the rate of fluid flow in the tubing.

Additionally, increased amperages of alternating current result in correspondingly higher hysteresis losses in magnetic conductors, such as the tubing string. The hysteresis losses manifest as energy losses that are not then available to heat the reservoir. Hysteresis losses may be controlled by reducing the frequency of the applied source of alternating current.

Further, the relatively high removal rate of heated oil, characteristic of vertical well production rates, places large heat loss demands on the formation, requiring relatively high sustained heating and thus high current levels.

In summary the disadvantages of the electrically heated vertical well system include:

- the relatively small sphere of heating;
- having physical limits to the maximum current levels; and
- creating high flow velocities, requiring large compensatory current levels to heat the reservoir.

There have been attempts by others to utilize horizontal well techniques (to involve greater portions of the reservoir), in combination with electrical heating techniques of the single wellbore approach described above. These efforts have suffered significant reductions in heating efficiency and ultimately supply only low levels of heating to the reservoir. Particularly, alteration of the single vertical well technology to horizontal well technology suffers the following disadvantages:

- That when attempting to heat the reservoir adjacent a 500 meter long horizontal well (electrode), the great volume of reservoir affected diminishes the reservoir resistance to $\frac{1}{4}$ to $\frac{1}{8}$ of the combined resistive loads of the power delivery and ground return systems. Thus the reservoir resistance becomes an alteration of the smallest of the circuit resistances. Using the single wellbore technology of the prior art vertical well, the efficiency of converting electrical energy to heating the reservoir would fall from about 80% to 10 to 25%; and
- That the efficiency is so poor, that to heat the reservoir electrically would require extremely high currents that could not be practically or economically attainable within the limits of the current state of the art.

With this background in mind it was the objective of the present invention to provide an electrically stimulated well arrangement and technique that would have increased influence on the reservoir, more effective use of the current supplied and result in improved production rates.

SUMMARY OF THE INVENTION

In accordance with the invention, a system for electrically heating a subterranean, oil-containing reservoir is provided. The system is characterized by increased maximum current rates and larger heated volumes of reservoir.

In an assembly aspect, the invention comprises:

a plurality of vertical wells, each having a wellbore extending into the reservoir and being cased down to the upper end of the reservoir;

a power conditioning unit ("PCU") located at each vertical well;

each vertical well having a supply electrode in electrical contact with the reservoir;

conductive means, such as a tubing string, connecting the positive lead of the PCU with the supply electrode, for supplying alternating current to the reservoir through the electrode;

a horizontal well having a wellbore consisting of a vertical riser leg and a horizontal liner leg, the liner leg extending through the reservoir in contiguous but spaced relation to the vertical wells, said riser leg being cased;

said liner leg containing a conductive apertured conduit or liner in electrical contact with the reservoir, said liner forming a return electrode extending substantially the length of the liner leg;

said riser leg containing conductive means (e.g. a tubing string) connected with the liner and the negative lead of the PCU;

each electrode being electrically isolated by non-conductive means from its associated casing string.

Thus a circuit is established whereby current flows from the PCU, down the tubing string and to the reservoir from the vertical well electrode. The current then spreads out into the conductive overburden and underburden regions, with little losses, and flows toward the horizontal liner. The current converges towards the horizontal liner through the adjacent reservoir and then flows through the liner and tubing string and returns to the PCU.

The invention is characterized by supplying current to the reservoir through a plurality of vertical wells and returning it through a single elongate return electrode positioned in the horizontal leg of a return well. In most cases, both the vertical and horizontal wells will be operated to produce liquid while electrical heating is on-going.

The development of an electrical heating process using the combination of separate vertical and horizontal well-electrodes has been influenced by seeking to solve problems related to the implementation of horizontal wells and electrical heating. More particularly, it was found:

That heat transfer into the reservoir by thermal conduction was a desirable feature which is best accomplished with a low fluid inflow, characteristic of horizontal wells but which is a liability with respect to the capability to cool high current loads;

That it was desirable to keep the supply electrode lengths as short as possible to keep the power conversion efficiency high. This was not feasible with a single wellbore, dual electrode, long horizontal well, and thus a plurality of vertical supply electrode wells are provided;

That using the horizontal well as the return electrode converted the ground return system losses to useful reservoir resistance and increased efficiencies back up to 40 to 60%;

That it was necessary to conduct high current into the large reservoir yet it was desirable to keep the current levels low per unit length of horizontal well, due to the low cooling capabilities of the characteristically low fluid flows. This was solved by providing multiple supply electrodes and staging the current flow in smaller discrete amounts into the horizontal well liner. As the accumulating current requires greater cooling, the accumulating volumetric flow correspondingly increases, adequately meeting the demand; and That as produced liquid rates dropped at the vertical wells, current would need to be reduced limiting the heating and production. However, as there is a horizontal producer, it is a possibility to extend production from the horizontal well by converting the vertical wells to water flood injectors to maintain adequate cooling for the required current while simultaneously flushing residual oils to the horizontal production well.

Turning now to a method aspect of the invention, there is provided a combination of steps comprising:

supplying current to a plurality of electrodes, each being disposed in one of a plurality of vertical wells, each electrode being in electrical contact with the reservoir, so that the current enters the reservoir; and returning the current through the conductive liner and tubing string (or cable) of a horizontal well extending into the reservoir in spaced relation from the vertical wells.

The applied frequency of the alternating current source is preferably controlled to frequencies less than the power frequency of 60 HZ, most preferably 5 to 60 Ht, so as to affect:

1. more efficient heating of the reservoir by minimizing losses in the liner, tubing and casing string; and
2. more uniform heating of the reservoir adjacent to the horizontal well by minimizing any wavelength effects which are a strong function of the frequency.

DETAILED DESCRIPTION OF THE PREFERRED EMBODIMENT

Figure 1:
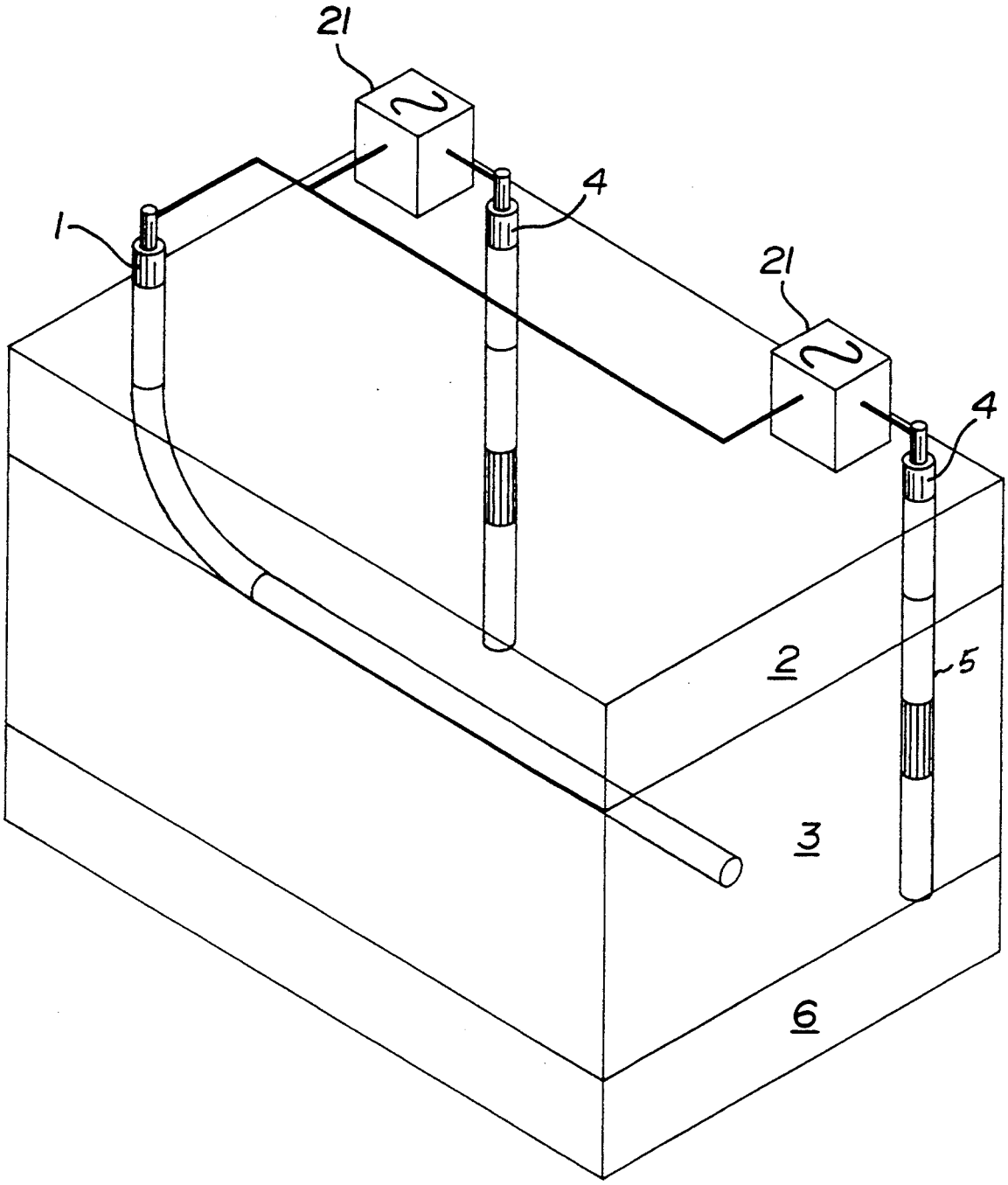
FIG. 1 is a perspective cutaway view of an oil-bearing reservoir and the assembly of the present invention.
Figure 2:
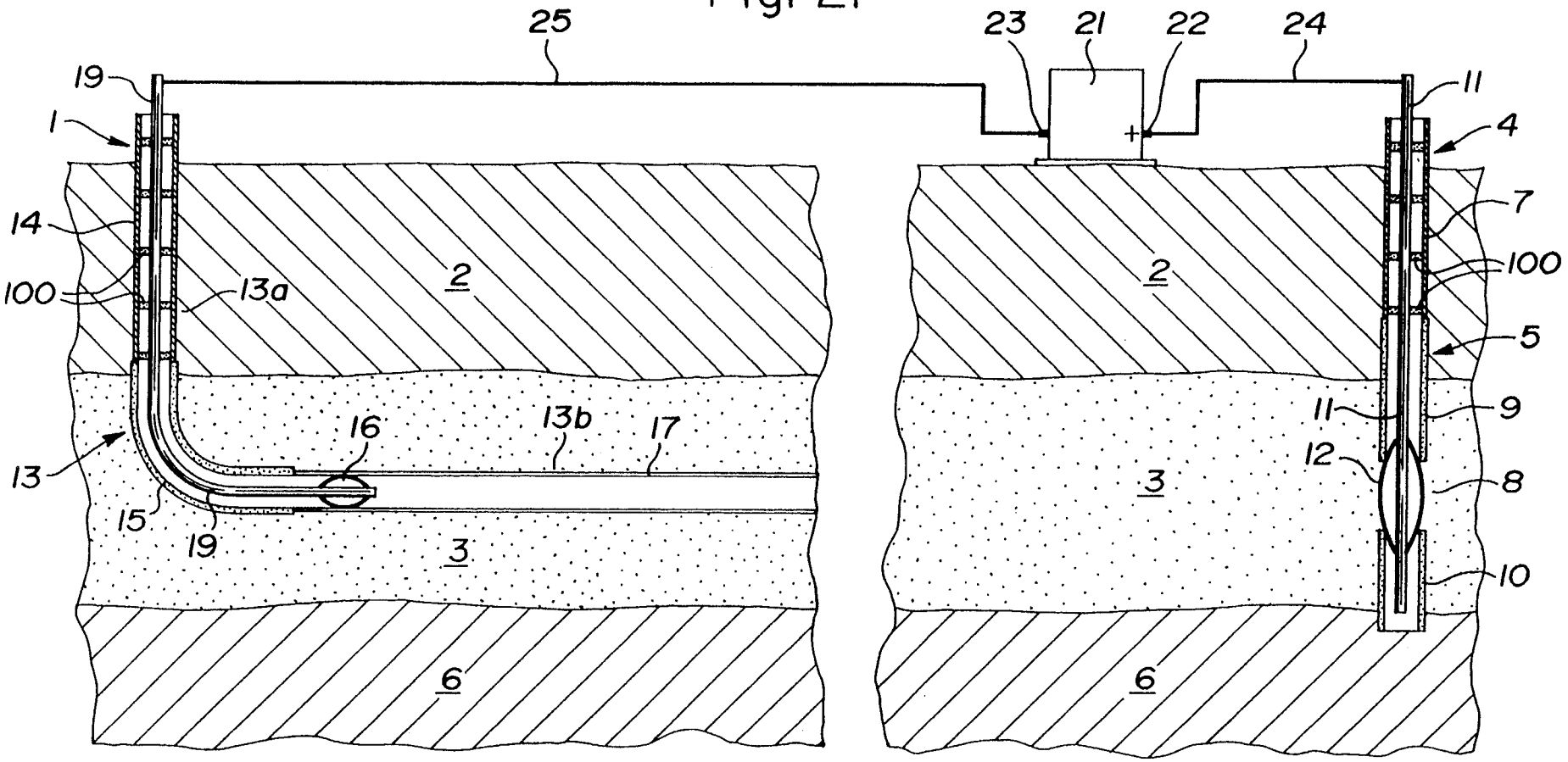
FIG. 2 is a schematic view of a horizontal well and ground return electrode, a vertical well and supply electrode, and a power conditioning unit.

Referring to FIG. 1, in a first embodiment of the invention, a horizontal well 1 is extended through the overburden 2 and into a reservoir 3. A plurality of vertical wells 4 are extended into the reservoir, being spaced apart from and substantially parallel to the horizontal well 1.

Each vertical well 4 is comprised of a wellbore 5 which extends through the overburden 2, through the oil-bearing reservoir 3 and into the underburden 6. A string 7 of conventional tubular steel casing is terminated at the overburden-reservoir interface.

An electrode 8 is located within the reservoir 3, being located at approximately the midpoint of the vertical extent of the reservoir 3. The electrode 8 is positioned below the casing string 7 and is separated therefrom by a non-conductive top tubular isolator 9, formed of fibreglass. A bottom tubular isolator 10, similarly constructed of non-conductive fibreglass, extends downward from the electrode 8 to the base of the wellbore 5. The top and bottom tubular isolators 9, 10 serve to electrically isolate the electrode 8 from the casing string 7 and the overburden and underburden 2, 6. The electrode 8 is in electrical contact with the reservoir 3.

The entire electrode 8 and the portions of the top and bottom tubular isolators 9, 10, which face the reservoir 3, are perforated for the ingress or egress of fluids.

A steel tubing string 11 extends concentrically through the casing string 7 and top isolator 9 and connects with the electrode 8. Electrical contact of the tubing string 11 and the electrode assembly 8 is formed with a conventional bow spring metal contactor 12. The tubing string 11 is electrically isolated from the casing string 7 by isolation centralizers 100 located intermittently along the length of the tubing string 11. The centralizers 100 are made from polyvinyl chloride.

The horizontal well 1 comprises a wellbore 13 which extends through the overburden 2, and curves to lie horizontally in the reservoir 3 above the underburden 6, more particularly at the midpoint of the vertical extent of the reservoir. The wellbore 13 consists of a vertical leg 13*a* and a horizontal leg 13*b*. A tubular steel casing string 14 extends through the vertical leg 13*a* and is landed at about the interface of the reservoir 3 and overburden 2. A tubular, non-conductive isolator 15 is formed of fibreglass and is positioned at the lower end of the casing string 14, to isolate a bow spring contactor 16 therefrom.

A tubular liner 17 extends horizontally through the reservoir 3, connected mechanically and electrically to the bow spring contactor 16. The liner 17 provides a ground return electrode extending substantially along the entire length of the horizontal leg 13*b*. The liner 17 is slotted to accept the ingress of produced fluids from the reservoir 3.

A second steel tubing 19 string extends downward through the vertical leg 13*a* of the wellbore casing 14 and the top isolator 15, and connects with the bow spring contactor 16. The tubing string 19 is electrically isolated from the casing string 14 by isolation centralizers 100 located intermittently along the length of the tubing string 19.

A power conditioning unit ("PCU") 21 is provided for each vertical well, having positive and negative leads 22, 23. The positive lead 22 is connected through a power delivery line 24 to the first tubing string 11 of its vertical well 4. The negative lead 23 is connected through a ground return line 25 to the second tubing string 19 of the horizontal well 1, thus completing the circuit for the alternating current source supplied by the PCU 21 to the vertical well 4.

Alternating current is supplied to each of the vertical wells 4, from the separate power conditioning units 21. Current flows through the power delivery lead 22 and line 24 to each of the first tubing strings 11, and through the bow spring contactors 12 to the supply electrodes 8. It will be understood that a cable could be substituted for the tubing string in each vertical well. Separate power conditioning units 21 enable power delivery to be tailored to individual well characteristics and cooling requirements.

From each supply electrode 8, the current flows through the reservoir 3 and into the overburden 2 and underburden 6. The current preferentially flows in the overburden and underburden formations as they are generally more conductive than the reservoir 3. The current then returns through the reservoir to collect, in a substantially uniform manner, at the liner 17.

The current passes along the liner 17 to the bow spring contactor 16 and up the tubing string 19. The ground return line 25 returns the current to the power conditioning unit 21, completing the circuit.

The use of the horizontal well as the ground return system has converted this resistive load, which was once a system loss, to useful reservoir load. The electrical efficiency of the reservoir heating is a function of the reservoir resistance (0.05–0.15 Ohm) divided by the sum of the reservoir resistance and ½ of the power delivery resistance (0.2 Ohm). This raises the efficiency to about 40 to 60%.

The current flow in the near-wellbore region of the liner 17 is sufficient to cause resistive or ohmic heating of the connate water in the reservoir and thus thermally reduce the viscosity of the contained fluids and remove or reduce the visco-skin effect, thereby reducing the resistance to flow, and increasing production.

Figure 3:
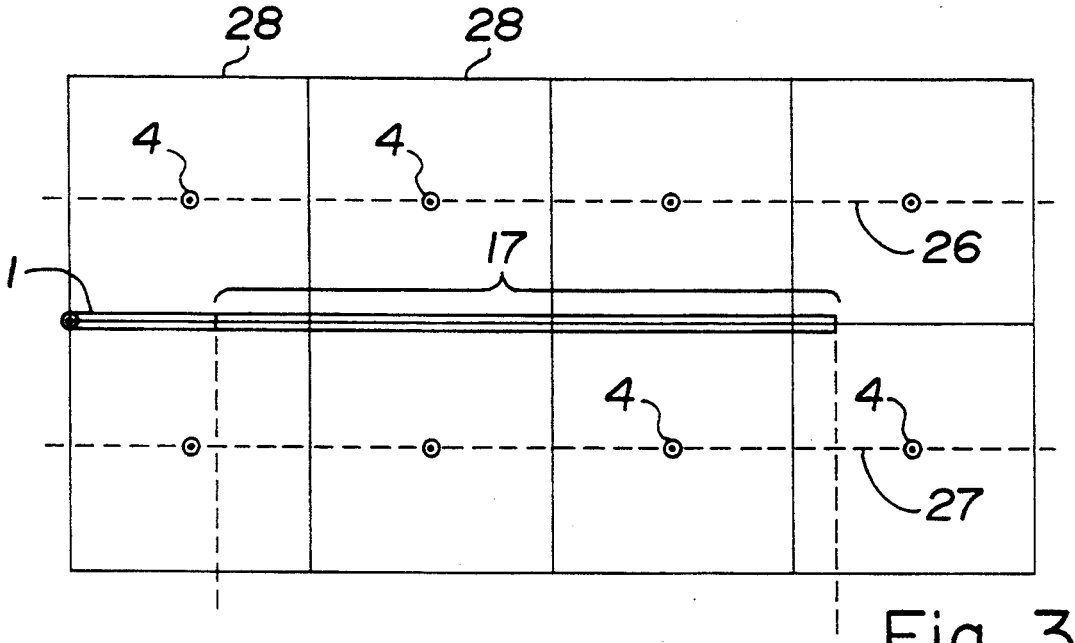
FIG. 3 is a plan view of an 80 acre modelled implementation of the assembly of the invention.
Figure 4:
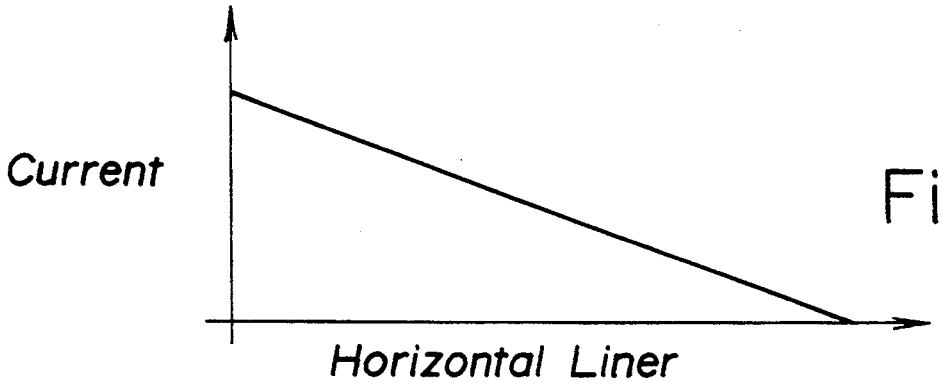
FIG. 4 is a graph showing the relative current flow in the ground return electrode of the horizontal well depicted in FIG. 3.
Figure 5:
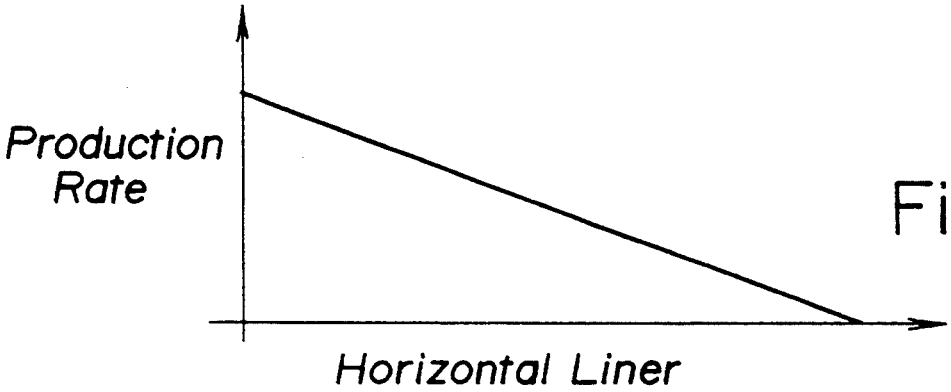
FIG. 5 is a graph showing the relative liquid production in the liner of the horizontal well depicted in FIG. 3.
Figure 6:
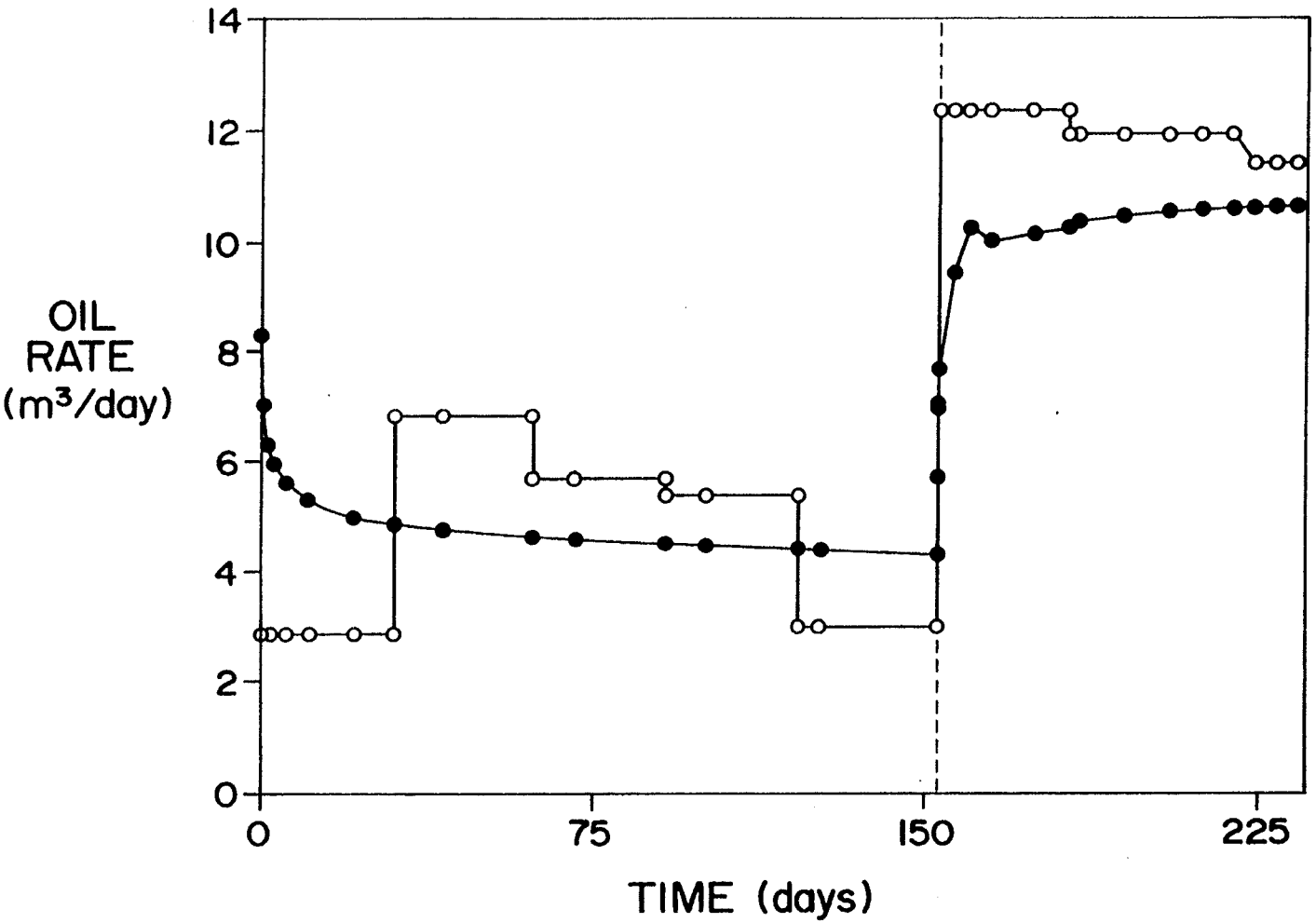
FIG. 6 is a graph of the liquid production rate of a typical vertical well of the prior art, with and without electromagnetic heating.

As shown in FIGS. 3, 4, and 5, the individual current from each of the vertical wells collects and accumulates on the horizontal liner. FIG. 4 shows the steadily increasing current accumulation. This increasing current would normally overwhelm the cooling capability of the low inflow rate per unit length of typical horizontal well production. FIG. 6, however, shows the corresponding increase in the production rate, accumulating along the liner. The liquid production increases, continuing to provide sufficient cooling as the current rises along the length of the liner.

In addition to the ohmic heating of the reservoir, there is a second heat transfer mechanism at play. The liner is heated due to ohmic and hysteresis losses of the electrical current. The temperature of the steel liner increases above that of the reservoir, thus transferring heat by conduction into the reservoir. As the inflow rate of liquid into the horizontal well is low per unit length of the liner, the loss of heat from the reservoir with the heated oil is low and conductive heat transfer is effective.

Numerical simulation techniques are herein used to compare the performance of the electrical heating of reservoirs with the method of the prior art, actual versus predicted, and the method of the present invention.

In order to forecast physical response of the reservoir and production, a three dimensional (3-D) model was prepared to simulate the process.

Referring to FIG. 3, a reservoir was modelled using the following parameters. More particularly, a horizontal production well 1 having a length of 500 meters was used. Two lines 26, 27 of four vertical wells were arranged about the horizontal well. Each line 26, 27 of the four vertical wells were spaced 100 meters laterally apart and parallel from the horizontal well 1. Each vertical well 4 was spaced 200 meters from each another. Each vertical well 4 was therefore situated in the center of a ten acre surface area 28. In other words a well arrangement, comprising a first line of four vertical wells, a linearly extending horizontal well and a second line of four more vertical wells, was provided in an 80 acre model.

Each vertical well electrode introduced 160 amperes of current to the reservoir, resulting in 640 amps per 4 well set for an accumulated ground return current flow of 8×160, or 1280 amperes at the horizontal well. Note that 160 amperes is at the low end of current typical in the prior art and is readily achieved. Note also that 1280 amperes has not been heretofore accomplished in the art, to the best of applicant's knowledge.

A commercial simulator (TETRAD, produced by Dyad Engineering Ltd., and distributed by Servi-Petro, both of Calgary, Alberta) was used to simplify creation of the model. TETRAD is a state of the art modelling package for simulating multi-component, thermal effects on reservoirs. The simulation routines provided can handle many aspects of reservoir modelling, some of which include: vertical and horizontal wellbore dynamics, multi-phases, multi-components, and thermal response of reservoirs. Electromagnetic heating is modelled with specific routines structured to model quasi-steady state approximations of Maxwell's equations.

Two dominant heat transfer mechanisms were modelled associated with the heating along the length of the horizontal well. The first is the ohmic heating response of electrical resistance to the flow of current, particularly in the electrolytic connate water present in the reservoir. Ohmic heating behaves according to power or heat generation being proportional to the square of the current flow times the resistance of the current's path. The connate water is heated, which then acts to thermally conduct heat to the surrounding formation. Secondly, the horizontal well liner, acting as the ground return electrode, similarly heats in response to ohmic losses and additionally to hysteresis losses.

Heat losses from the formation are considered, as ambient temperature reservoir oils displace the heated oils, as they are produced from the well. Optimum current levels are imparted to the reservoir to maintain a steady state elevated temperature at the well, balancing electrical heating and fluid cooling effects.

The actual increase in temperature to sufficiently decrease the oil viscosity and remove the visco-skin effect is not overly large. The dead oil viscosity (in centipoise, cp) for a heavy oil can be estimated relatively accurately with the following correlation developed by Puttagunta, V. R., Singh, B., and Cooper, E., and disclosed in "A generalized viscosity correlation for Alberta heavy oil and bitumen," a paper delivered at the 1988 UNITAR/UNDP conference:

$$\mu_{oil} = 10^{\left[\frac{b}{\left(1+\frac{T-30}{303.15}\right)^s}+C\right]}$$

where for heavy oil, typical for the Lloydminster area of Alberta, Canada, b is 6.48, s is 3.56, and C is −3.002. At the initial reservoir temperature of 20° C., the dead oil viscosities calculated by the above equation are about 20,000 cp. The viscosity calculated at the initial reservoir temperature is also by definition the maximum viscosity of the oil due to the visco-skin effect. In contrast, at a slightly elevated temperature of 50° C., it is calculated to be less than 200 cp, showing a 100 fold decrease in viscosity with less than a threefold increase in temperature. Typically, the operating temperature near the wellbore can reach 100° C., with resultant oil viscosities of about 2 cp; 10000 times less than the viscosity of the visco-skin.

Additional reservoir properties, appropriate to the particular formation being modelled, are used to complete the stimulation parameters and provide the best prediction of the reservoir behaviour under electrical heating stimulation.

The properties of a heavy oil reservoir and its hydrocarbon components used for the model are listed in Table 1 as follows.

| RESERVOIR PROPERTIES | units | Reservoir Rock | Overburden & Underburden |
|---|---|---|---|
| Pay Thickness | (m) | 4 | |
| Porosity | | 30% | |
| Oil Saturation | | 83% | |
| Water Saturation | | 17% | |
| Gas Saturation | | 0% | |
| Solution GOR | ($m^3/m^3$) | 12.40 | |
| H. Permeability | (mD) | 3000 | |
| V. Permeability | | 2000 | |
| Res. Temperature | (C) | 26.8 | |
| Res. Pressure | (kPa) | 5450 | |
| Rock Compressibility | (/kPa) | 0.000035 | |
| Thermal Conducitivty | (J/m.d.C) | 149500 | 149500 |
| Electrical Cond. | (1/Ohm.m) | .035 | |
| Heat Capacity | ($J/m^3.C$) | 2347000 | 2347000 |

| HEAVY OIL PROPERTIES | Units | | |
|---|---|---|---|
| Density | ($kg/m^3$) | 994 | |
| Viscosity | (cp) | 4875 | @ Ref temp 27° C. |
| Molecular Weight | | 340 | |
| Heat Capacity | (J/gmole.C) | 1278 | |

| POWER CONDITIONS | Units | Value |
|---|---|---|
| Voltage/well | (Vrms) | 2000 |
| Frequency | (Hz) | 60 |
| Amperage/well | (A) | 160 |
| Total Amerage (4 well) | (A) | 640 |

Operation of the model with the above parameters provides a prediction of the performance of the electromagnetic stimulation related to proximity to well and over time.

The numerical simulation was tested on the prior art as shown in FIG. 6. Predicted and actual production rates, from an electromagnetic stimulated vertical well of the prior art form, are presented. Good correlation is provided in both pre- and post-stimulation cases, with stimulated oil production rates achieved upwards of 12 $m^3$/day.

Figure 7:
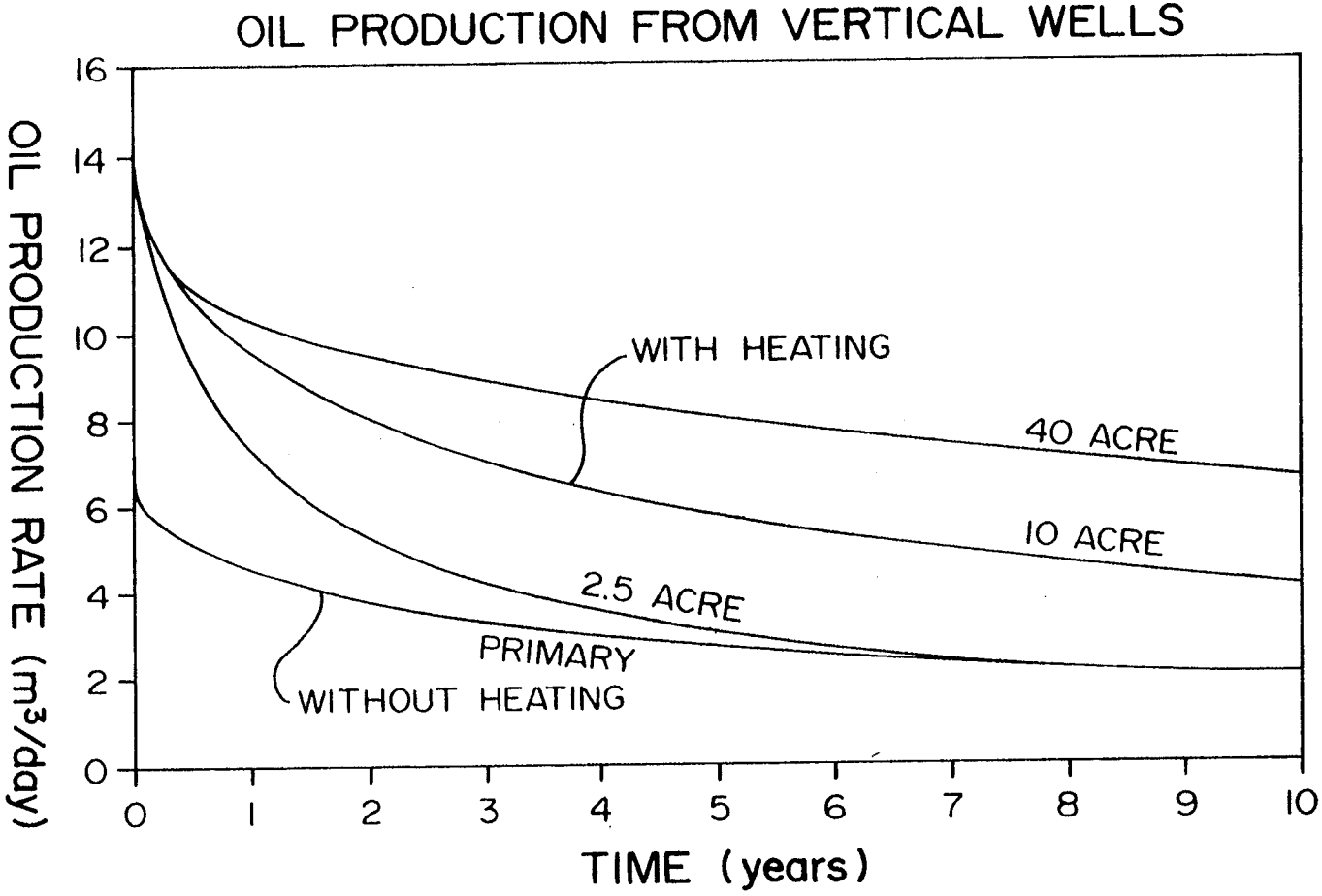
FIG. 7 is a graph of the predicted liquid production rate from each of the vertical wells of a numerical model of the present invention, with and without electromagnetic heating.

In FIG. 7, oil production from the vertical wells of the present invention is seen to increase predictably (from 6 to 12 $m^3$/day) with electromagnetic heating. Current is applied to the vertical wells in proportion with the cooling capability of the liquid production. At some point, the production falls to a threshold level at which the current cannot be further reduced without affecting horizontal production. At this point, water flood injection or cooling circulation may be substituted so that sufficient current can again be provided to heat the reservoir along the length of the horizontal liner, while simultaneously enhancing liquid recovery from the horizontal well.

Figure 8:
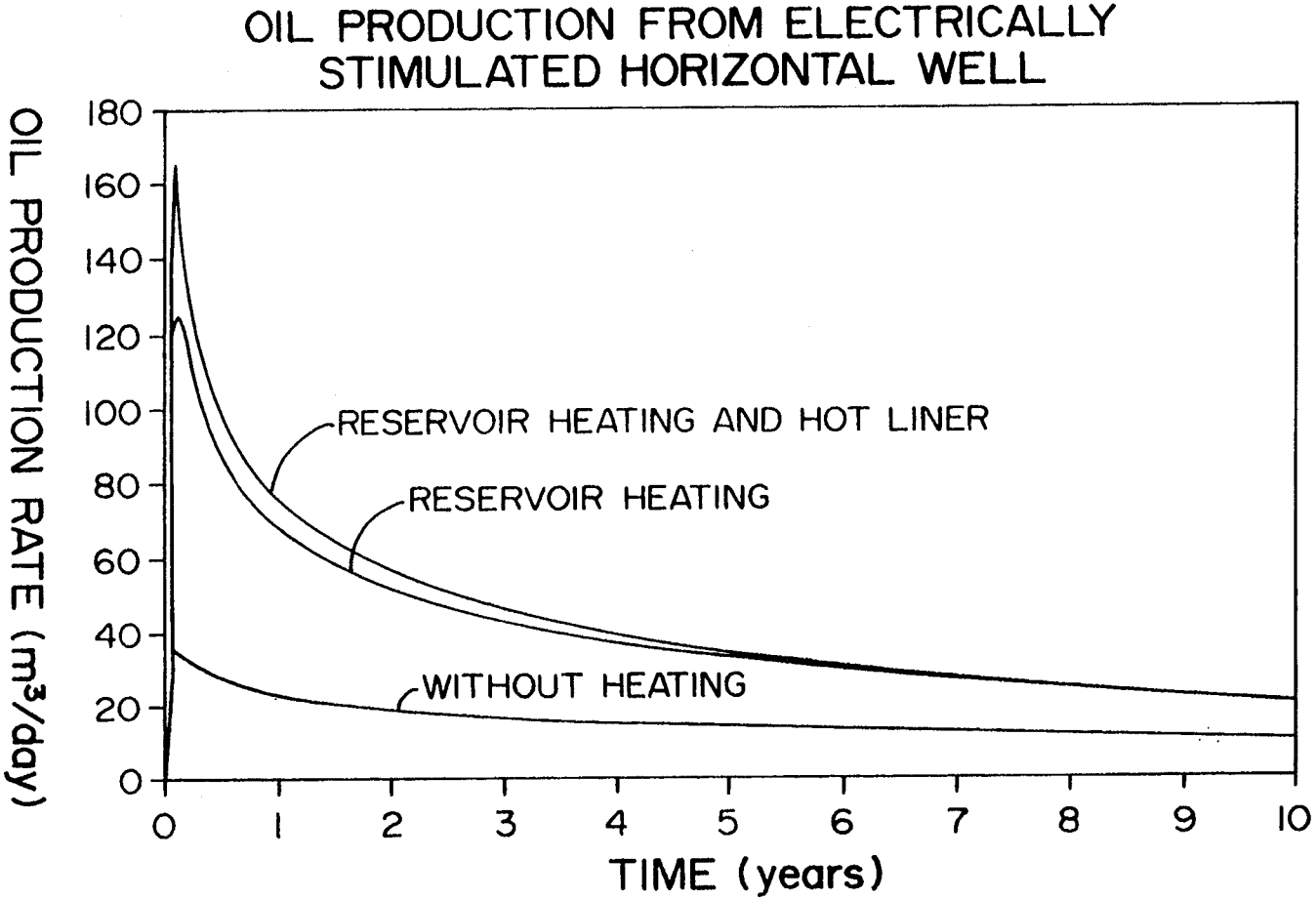
FIG. 8 is a graph of the liquid production rate of the horizontal well of FIG. 7, with and without electromagnetic heating.

Performance of the horizontal well of the present invention is presented in FIG. 8, extended over a ten year life. Three curves are shown, presenting the production from a 500 meter horizontal well: without the benefit of the present invention; using the method of the present invention considering only heat transfer effects of the electromagnetic effects on the reservoir; and considering additionally the heat conduction effects of a hot liner. Rates are seen to increase markedly from a peak of about 35 $m^3$/day without stimulation to over 160 $m^3$/day when initially heated. Even after two years, the stimulated rates are greater than 50 $m^3$/day.

The embodiments of the invention in which an exclusive property or privilege is claimed are defined as follows:

1. An assembly for electromagnetic heating of a subterranean, oil-containing reservoir comprising:

a plurality of vertical wells, each having a wellbore extending into the reservoir and having a casing string extending down to the upper end of the reservoir;

means for supplying alternating current to each vertical well;

each vertical well having a supply electrode in electrical contact with the reservoir;

conductive means in each well connecting the current supply means with the supply electrode, for supplying alternating current to the reservoir through the electrode;

a horizontal return well having a wellbore consisting of a vertical riser leg and a horizontal leg extending through the reservoir in spaced relation to the vertical wells, said riser leg being cased with a casing string;

said horizontal leg containing a conductive apertured conduit in electrical contact with the reservoir, said conduit forming a return electrode extending substantially the length of the horizontal leg;

said riser leg containing conductive means connecting the conduit with the current supply means;

each electrode being electrically isolated from its associated casing string.

2. The assembly as set forth in claim 1 wherein:

the vertical wells are generally linearly aligned with the return well horizontal leg.

3. A method for electromagnetically heating a subterranean, oil-containing reservoir penetrated by a plurality of vertical wells, each having conductive means adapted to supply alternating current to a relatively short electrode in electrical contact with to the reservoir, and a horizontal well having conductive means adapted to return current to ground from a relatively long electrode disposed in the horizontal leg of the well, comprising:

simultaneously supplying alternating current, through the electrodes of the vertical wells, to the reservoir;

returning the current supplied from the vertical wells to ground through the long electrode and conductive means of the horizontal well; and simultaneously producing oil through all of the wells.

4. The method as set forth in claim 3 wherein:

the frequency of the alternating current supplied is in the range 5–60 HZ.

* * * * *